United States Patent [19]

Vodopyanov et al.

[11] 4,114,415

[45] Sep. 19, 1978

[54] PROFILE PLANO-TYPE KNURLING MACHINE

[76] Inventors: Jury Mikhailovich Vodopyanov, ulitsa Depovskaya, 13, kv. 51; Nikolai Emelyanovich Klimkin, ulitsa P. Guschina, 75, kv. 27; Ivan Ivanovich Savvateev, ulitsa Molodezhnaya, 70, kv. 92; Vladimir Sergeevich Strelchenko, prospekt Lenina, 87, kv. 57; Alexandr Pavlovich Kuris, ulitsa Dekabristov, 6, kv. 7; Sergei Ivanovich Koltsov, ulitsa Pobednaya, 78, all of Barnaul, U.S.S.R.

[21] Appl. No.: 737,775

[22] Filed: Nov. 1, 1976

[51] Int. Cl.[2] ..... B21B 17/00

[52] U.S. Cl. ..... 72/214; 72/224

[58] Field of Search ..... 72/224, 214, 180

[56] References Cited

U.S. PATENT DOCUMENTS 2,929,282 3/1960 Retterath ..... 72/224

4,004,442 1/1977 Stretchenko ..... 72/214

*Primary Examiner*—Milton S. Mehr

*Attorney, Agent, or Firm*—Fleit & Jacobson

[57] ABSTRACT

A profile plano-type knurling machine relates to metal pressure shaping machinery. It is more expedient to use the present invention for working splined shafts, polygonal parts and gears. In the present knurling machine a device for moving knurl rollers in the radial direction relative to the centers has tapered elements kinematically associated with the knurl rollers and pressure members whereas only one pressure member intended to provide the radial feed of the knurl rollers is installed on the fixed support member at the side of the bases of the tapered elements coaxially to the centers and adapted for actuating simultaneously all the tapered elements through an intermediate part located between said pressure member and the bases of the tapered elements. This technical solution provides for a considerable improvement of the machine efficiency and its reliability in operation as well as processing accuracy of the work pieces being machined.

14 Claims, 18 Drawing Figures

PROFILE PLANO-TYPE KNURLING MACHINE

BACKGROUND OF THE INVENTION

The present invention relates to metal pressure shaping machinery and more particularly to profile plano-type knurling machines.

The present invention can be more successively used for shaping splines on shafts, teeth of gears, polygonal pieces and so on.

Known in the prior art are profile plano-type knurling machines (cfr USSR Inventor's Certificate No. 350,553, Cl.B21*h* 7/14) wherein mounted between fixed support members carrying movable and fixed centers for placing the work piece and rigidly connected to each other by ways is a movable support member with a possibility for reciprocations along said ways carrying a knurling head being coaxial to the centers and having knurl rollers and there is a device for moving the knurl rollers in the radial direction relative to the centers, comprising tapered elements mounted in the knurling head with a possibility for adjustment movements in the axial direction relative to the centers and kinematically associated with the knurl rollers and pressure members actuating the tapered elements in the extreme positions of the movable support member for a radial feed of the knurl rollers and their return to the starting position.

Said device for the radial feed of the knurl rollers and their return to the starting position in the known knurling machines has pressure members made in the form of bars rigidly secured onto the fixed support members. Each of these bars is installed in front of the apex or base of one of the tapered elements in such a way that their axes parallel to the centers.

The radial feed of the knurl rollers is performed prior to each working travel of the movable support member with the knurling head. The movable support member is moved towards the fixed traverse facing the bases of the tapered elements. In the course of movement of the movable support member near its extreme position the butt of the free end of each bar installed on said fixed support member actuates the base of a respective tapered element. The bar actuates this tapered element to move it in the axial direction relative to the centers.

The knurling head has a housing provided with radial slots. Each of these slots accommodates a slider with the knurl roller and the tapered element of said device associated kinematically therewith and installed between the bottom of the slot and the slider.

When the tapered element moves its inclined surface actuates the inclined surface of the slider, thus moving said slider with the knurl roller in the radial slot towards the work piece at a distance equal to a preset value of the radial feed of the knurl rollers.

After the knurl rollers are fed radially, one progressive motion of the movable support members with the knurling head is performed. In the course of this motion of the movable support member with the knurling head the knurl rollers start processing the workpiece thus shaping the profile elements to a depth relative to the value of the first radial feed of the knurl rollers. This motion is a working travel. In the course of the backward travel of the movable traverse with the knurling head the knurl rollers start processing the work piece only in the range of the resilient deformations and therefore this motion of the movable support member is an idle travel. These reciprocations of the movable support member repeat until the profile elements are fully shaped. At the end of each backward travel of the movable support member with the knurling head whose length increases constantly the bars actuate the tapered elements whereas said bars move the tapered elements to a distance relative to the value of the radial feed of the knurl rollers for shaping the profile at a working travel of the movable support member with the knurling head.

When the profile shaping cycle has been finished the movable support member with the knurling head is stopped in the starting position. The processed work piece is removed from the working area.

The knurl rollers return their home position. For the purpose the movable support member with the knurling head is moved towards the fixed support member facing the apeces of the tapered elements. At the end of this travel the pressure members secured onto this fixed support member actuate the apeces of the tapered element, thus moving these tapered elements in the axial direction relative to the centers towards their bases.

The sliders with the knurl rollers are pressed by compression springs to the tapered elements and therefore when the cotters move towards their bases the sliders with the knurl rollers are moved in the radial slots from the centers and thus return their home position.

Prior to knurling a work piece of a defined dimension the bars should be adjusted to a preset height. Since the known knurling machines are provided with a comparatively great amount of these bars which at the same time should be adjusted accurately with a minimum difference in height from each other to obtain the preset accuracy of the profile elements in the course of knurling, the adjustment cycle of these knurling machines is sufficiently laborous and requires much time.

This complicated adjustment of the knurling machine does not provide as a rule for the preset accuracy of the radial feed of knurl rollers, thus decreasing the accuracy of the profile elements being knurled.

As a result the knurled profiles should be worked additionally to correct their geometrical dimensions and achieve the preset accuracy. These additional operations increase substantially the labour in the manufacture of the profiles, require the application of additional equipment for performing same.

Idle travels of the movable support member with the knurling head and compartively laborous adjustment of the knurling machine reduce greatly the efficiency thereof.

In addition, the great amount of pressure members and possible optional motions of tapered elements and therefore the knurl rollers in the course of knurling reduce greatly the operational reliability of the known knurling machine and the accuracy of the work piece being processed.

SUMMARY OF THE INVENTION

It is the main object of the present invention to raise the efficiency of the knurling machine.

It is another object of the present invention to enhance the quality of the profiles being knurled.

It is still another object of the present invention to reduce the labour when manufacturing the profiles.

It is still another object of the present invention to simplify the embodiment of the knurling machine as a whole unit and increase its operational reliability and life.

These and other objects are attained by providing a profile plano-type knurling machine wherein mounted between fixed support members carrying movable and fixed centers for placing the work piece and rigidly coupled to each other by ways is a movable support member with a possibility for reciprocations along these ways, carrying a knurling head having knurl rollers and being coaxial to the centers and there is a device for moving the knurl rollers radially relative to the centers, comprising tapered elements mounted in the knurling head with a possibility for adjustment movements axially relative to the centers and kinematically associated with the knurl rollers as well as pressure members actuating the tapered elements in the extreme positions of the movable support member for the radial feed of the knurl rollers and their return to the home position. In the profile plano-type knurling machine according to the present invention, for the radial feed of the knurl rollers the device on the fixed support member at the side of the bases of the tapered elements has one pressure member only, coaxial to the centers and adapted for actuating simultaneously all the tapered elements through an intermediate part arranged among this pressure member and the bases of the tapered elements.

The use of one pressure member to perform the radial feed of the knurling head instead of a plurality thereof permits to reduce the adjustment cycle of the knurling machine, simplify its embodiment and therefore raise its efficiency and operational reliability. A possibility to move simultaneously the tapered elements by one pressure member provides for an accuracy of their movement and therefore the accuracy of the profiles being knurled.

It is expedient that the pressure member should be made in the form of a disc which should be resiliently pressed towards the movable support member. This provides for the accuracy of the mutual arrangement of the tapered elements relative to each other and therefore knurl rollers, especially prior to the last working travel to ensure the stability of the dimensions of the knurled profiles. In addition, this arrangement of the disc permits to compensate, the lack of accuracy in the stoppages of the movable support member with the knurling head and eliminate the emergency situations.

It is also expedient that the intermediate part should be made in the form of a flat ring coupling to each other the tapered elements and having the diameter of the hole less than that of the disc whereas the amount of pressure members for returning the knurl rollers to the starting position should be less than the amount of tapered elements and pressure members for returning the knurl rollers to the starting position should be taken in an amount of two when the number of tapered elements is even and in an amount of three when the number of tapered elements is uneven and they should be substantially arranged equidistantly from each other.

This embodiment of the present invention provides for a movement of the tapered elements and therefore knurl rollers to a strictly equal distance, thus raising the accuracy of the profiles being knurled and permits to minimize the amount of the pressure members for returning the knurl rollers to the starting position.

This embodiment of the present invention permits to simplify the structure of the knurling machine and its service, remove the obstructions from the work piece processing area, thus allowing to use automatic devices for loading and unloading the work piece and therefore to use the knurling machine in the automatic working lines.

The rigid coupling of all the tapered elements to each other eliminates an optional movement of separate tapered elements, thus raising the operational reliability of the knurling machine.

It is expedient that as pressure members for returning the knurl rollers to the starting position use should be made of movable members of jacks coupled to a ring and having fixed members mounted on the movable support member.

The use of the jacks in the embodiment according to the present invention permits to eliminate the necessity to arrange on the fixed traverse the pressure members for returning the knurl rollers to the starting position as well as the necessity to displace the movable traverse for performing a return of the knurl rollers to the starting position. In addition, this embodiment of the present invention permits the elimination of obstruction from the work piece processing area, thus making the knurling machine move convenient to service and permitting the use of knurling machine is an automated assembly line.

It is also expedient to provide the movable members of these jacks with braking devices mounted on the movable support member.

It is expedient that the master former should be made in the form of different height stops located on the disc uniformly on the circumference and each of them should be in front of the respective tapered element whereas the disc should be mounted with a possibility for a rotation about its axis and it is quite practical to use for the purpose a known ratchet-and-pawl mechanism associated with the disc through the ratcher wheel and through the pawl with the drive gear.

It is also expedient that the different height stops should be installed in height in such a way that adjacent stops should have different heights which should be equal over one stop and that said stops should be adjustable in height.

Other objects and advantages of the present invention will become more apparent from the following detailed description of a preferred embodiment thereof with due reference to the accompanying drawings, wherein:

DESCRIPTION OF THE PREFERRED EMBODIMENT

DETAILED DESCRIPTION OF THE PREFERRED EMBODIMENT

Figure 1:
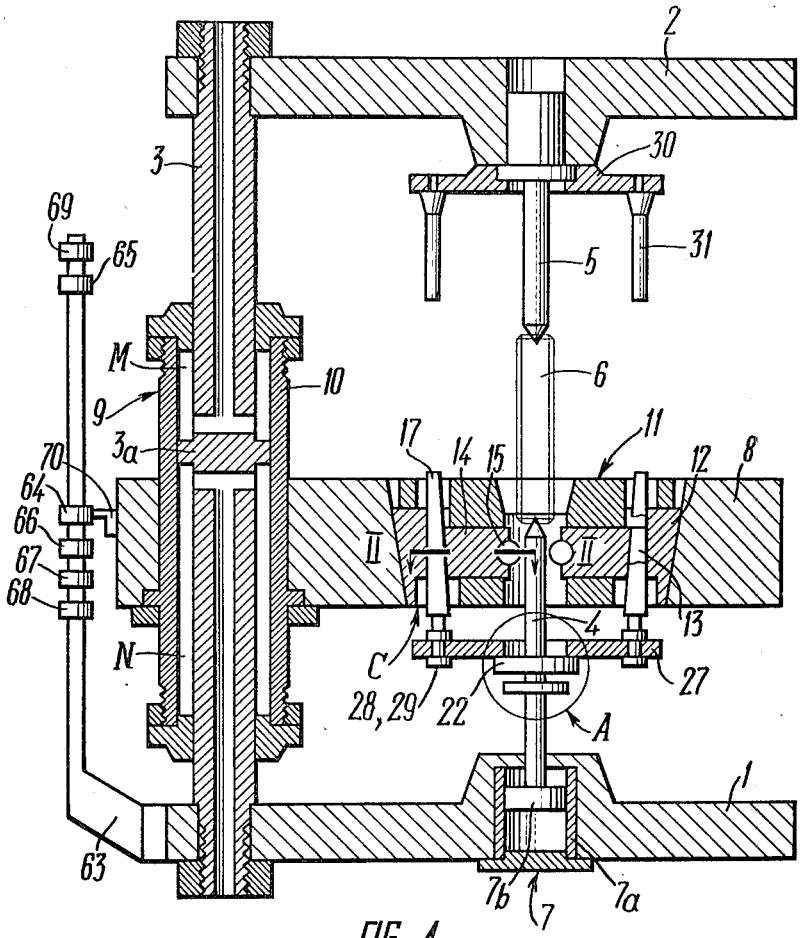
FIG. 1 is a longitudinal section of the profile plano-type knurling machine, according to the invention.

Referring to the accompanying drawings, the profile plano-type knurling machine has two fixed support members 1 and 2 (FIG. 1) arranged opposite to each other. One of these fixed support member is secured onto a box-type support (not shown). Said support members 1 and 2 are connected rigidly to each other by three equidistant ways 3 which are cylindrical. The fixed support member 1 mounts a movable center 4 and the fixed support member 2 mounts a fixed center 5 for placing the work piece 6 being processed. The movable center 4 is mounted on the fixed support member 1 by using a jack 7. A cylinder 7*a* of the jack 7 is coupled rigidly in the fixed support member 1 and its piston 7*b* is associated with the center 4 by a known manner.

The fixed center 5 is coupled rigidly onto the fixed support member 2 coaxially to the movable center 4.

Mounted on the ways 3 between the fixed support members 1 and 2 is a movable support member 8. The movable support member 8 may reciprocate along centers 4 and 5 by means of three jacks 9 mounted each on one way 3.

A cylinder 10 of each jack 9 is rigidly coupled to the movable support member 8. Each cylindrical way 3 is provided with a collar 3*a* (as shown in FIG. 1) which is a piston of said jack 9. Each cylindrical way 3 is provided with holes to supply a fluid to cavities M and N of the jack 9.

Figure 2:
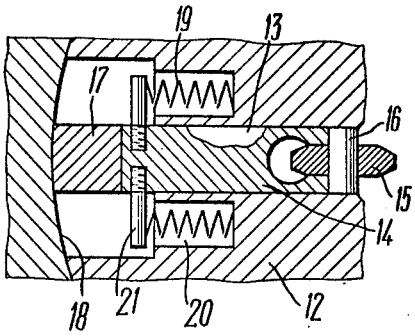
FIG. 2 is a section along II—II of FIG. 1 in an enlarged scale.

A detachable knurling head 11 is installed in the movable support member 8 coaxially to the centers 4 and 5. The knurling head 11 has a housing 12 provided with radial slots 13 (FIG. 2). Each of these radial slots 13 accommodates a slider 14 with the knurl roller 15 pivoted on an axle 16. The axle 16 in the known manner is secured by its ends in the slider 14. The knurling machine has also a device for moving the knurl rollers 15 radially relative to the centers 4 and 5. This device comprises tapered elements 17 facing with its apeces the fixed support member 2. The tapered elements 17 mounted in the knurling head have a possibility for adjustment movements in the axial direction relative to the centers 4 and 5. Each of said tapered elements 17 is located in the radial slot 13 between its bottom 18 (FIG. 2) and the slider 14. Each slider 14 is pressed to the respective tapered element 17 by two springs 19 of compression to perform a kinematic coupling of this tapered element 17 to the respective knurl roller 15.

Figure 3:
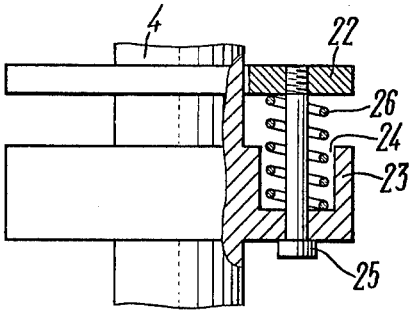
FIG. 3 shows an assembly A of FIG. 1 according to the invention, in an enlarged scale.

The housing 12 of the knurling head 11 in parallel to each slot 13 on both sides thereof is provided with cylindrical blind holes 20. Said holes 20 accommodate said springs 19 whereas each of said springs by one end is loaded to the bottom of the hole 20 and the other end thereof is secured on a pin 21 which is fixed in the slider 14 (as shown in FIG. 2). The device for moving the knurl rollers 15 radially relative to the centers 4 and 5 also contains pressure members for the radial feed of the knurl rollers 15 and their return to the starting position. For the radial feed of the knurl rollers 15 said device, according to the invention, has only one pressure member 22 (FIG. 1) which according to the invention, is installed on the fixed support member 1 coaxially to the centers 4 and 5 and adapted for simultaneously actuating the tapered elements 17 when the movable support member 8 is in the extreme position. This pressure member 22 is made in the form of a disc (FIG. 3). Furthermore the pressure member 22 will be disc 22 throughout the text.

The disc 22 has a central hole which is used to put said disc 22 onto the center 4 (as shown in FIG. 3). The disc 22 is pressed resiliently towards the movable support member 8. For the purpose the center 4 is provided with a collar 23 with an annular recess 24 at the side of its butt end facing the disc 22. The collar 23 is provided with holes made equidistantly on the circumference where through bolts 25 pass (as shown in FIG. 3). The bolts 25 by its threaded portion is screwed into the holes made in the disc 22 coaxial to the holes in the collar 23.

Put on each bolt 25 is a compression spring 26 whose one end is loaded to the bottom of the annular recess 24 and the other end thereof is loaded to the butt end of the disc 22.

According to the invention, the disc 22 has a possibility to actuate the tapered elements 17 through the intermediate part located between the bases of the tapered elements 17 and the disc 22. This intermediate part is made in the form of a flat ring 27 (FIG. 1) coupling to each other the tapered elements 17. The flat ring 27 is provided with holes made equidistantly on the circumference each in front of the base of the respective tapered element 17. A bolt 28 passes through each of these holes, is secured on the ring 27 with a nut 29 (as shown in FIG. 1) and screwed into the base of the respective tapered element 17.

The central hole of the ring 27, according to the invention, has the diameter less than the outer diameter of the disc 22.

Secured onto the fixed support member 2 coaxially to the center 5 is a round plate 30 carrying pressure members 31 for returning the knurl rollers 15 to the starting position. The amount of pressure members 31, according to the invention, is less than the number of tapered element 17.

When the number of tapered elements 17 is even, it is practical to use two pressure members 31. In this case the pressure members 31 are located diameterally relative to the centers 4 and 5 in front of the apeces of two respective tapered elements 17. When the number of tapered element 17 is uneven, it is preferable to use three pressure members 31 located substantially at a distanceequal from each other in front of the apeces of the respective three tapered element 17. This condition prevent the tapered elements 17 from skewing in the course of their axial movement relative to the centers 4 and 5. Each pressure member 31 is made in the form of a bar whose one end is secured in the plate 30 so that its axis is parallel to the centers 4 and 5.

Figure 4:
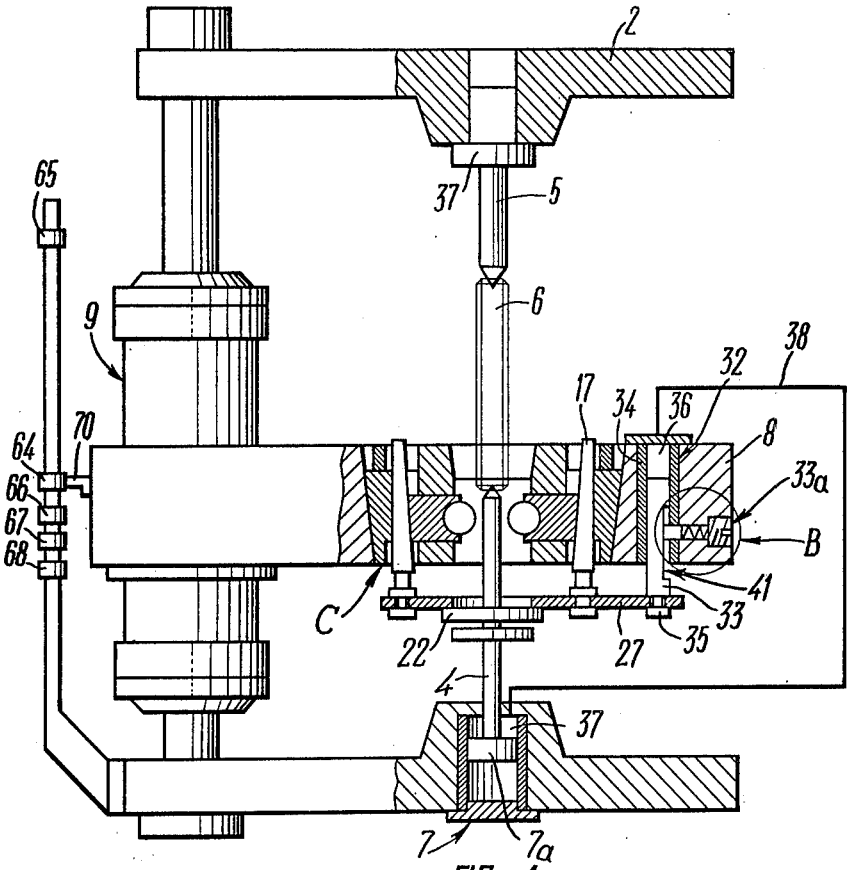
FIG. 4 shows another embodiment of the profile plano-type knurling machine with a device for moving radially the knurl rollers relative to the centers, according to the invention.

According to another embodiment of the present invention, as pressure members for returning the knurl rollers 15 to the starting position use is made of movable members of jacks 32 (FIG. 4).

In the case the movable member thereof is a plunger 33 of the jack 32. The fixed members of the jacks 32 (cylinders 34) are rigidly secured in the movable support member 8 (as shown in FIG. 4) at an equal distance from each other.

Each plunger 33 by its free end is coupled to the ring 27. For the purpose said ring 27 on its outer outline has eyelets with holes wherethrough bolts 35 pass. By the threaded portion each bolt 35 is screwed into the butt of the free end of the plunger 33.

The jacks 32 have cavities 36 which communicate with the rod cavity 37 of the jack 7 (as shown in FIG. 4) by means of a flexible pipe line 38.

Figure 5:
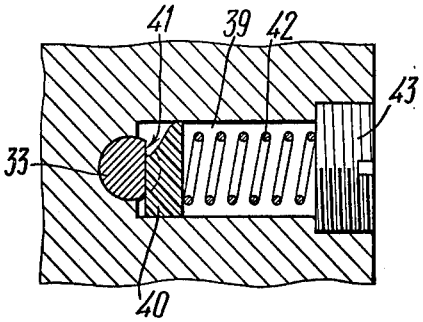
FIG. 5 shows an assembly B of FIG. 4 in an enlarged scale.

According to the invention, each plunger 33 is provided with a braking device 33*a* mounted in the movable support member 8. For the purpose the movable support member 8 is provided with radial holes 39 (FIG. 5) made in such a way that their axes cross the axes of the respective jacks 32. Installed in each of these holes 39 is a slide block 40. The side surface of the plunger 33 is provided with a flat 41 which supports one of the butt of the slide block 40. The slide block 40 is pressed by a compression spring 42 installed between the slide block 40 and a plug 43 screwed into the threaded portion of the hole 39 (as shown in FIG. 5). The flat 41 (FIG. 4) has the length which corresponds to the length of the axial movement of the plunger 33 whereas said length is equal to the maximum movement of the tapered elements 17 axially relative to the centers 4 and 5.

Figure 6:
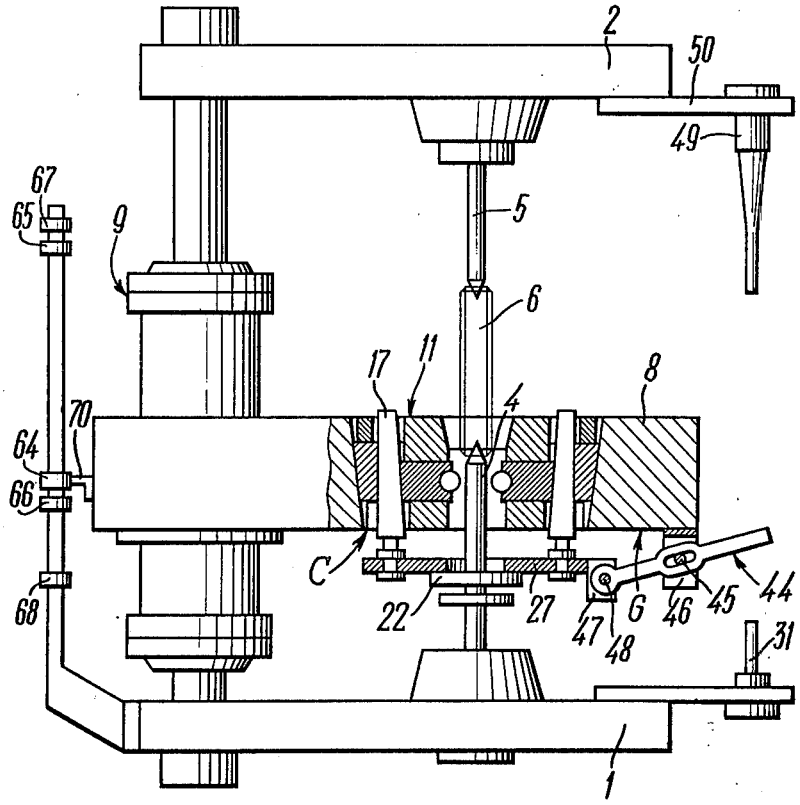
FIG. 6 is the same view of FIG. 4 for the next embodiment of the present invention.

According to the next embodiment of the present invention a device for moving the knurl rollers 15 radially relative to the centers 4 and 5 is provided with double-arm levers 44 (FIG. 6). An axle 45 of rotation of each double-arm lever 44 is mounted on the movable support member 8 (as shown in FIG. 6).

For the purpose brackets 46 are installed on the butt end G of the movable support member at the side of the bases of the tapered elements 17 whereas an axle 45 is mounted in each of said brackets. The double-aem lever 44 has a through slot made in the middle portion thereof (as shown in FIG. 6) and the axle 45 passes through said slot. Each double-arm lever 44 by one end is hinged onto the flat ring 27. For the purpose the flat ring 27 is provided with eyelets 47 whereas each of said eyelets accommodates an axle 48 which passes through the hole made on one end of the double-arm lever 44.

In this embodiment of the present invention the pressure members 31 for returning the knurl rollers to the starting position are mounted on the fixed support member 1 at the side of the bases of the tapered elements 17. Each of these pressure members 31 is located in front of the free end of one of the double-arm levers 44. Mounted for the purpose on the fixed support member 1 are brackets whereas each of said brackets accommodates the pressure member 31 (as shown in FIG. 6).

Situated on the fixed support member 2 at the side of the apeces of the tapered elements 17 are additional pressure members 49 for the radial feed of the knurl rollers 15. These pressure members 49 are made in the form of bars whereas each of said bars by one end is secured into a bracket 50 of the fixed support member 2. The pressure members 49 are coaxial to the pressure members 31 and parallel to the centers 4 and 5.

An amount of double-arm levers 44 is used in the range from two to three. When the number of tapered elements 17 is even the amount of double-arm levers is equal to two and when the number of tapered elements 17 is uneven the amount of double-arm levers is equal to three. The amount of pressure members 31 and additional pressure members 49 is equal to the number of double-arm levers 44.

Figure 7:
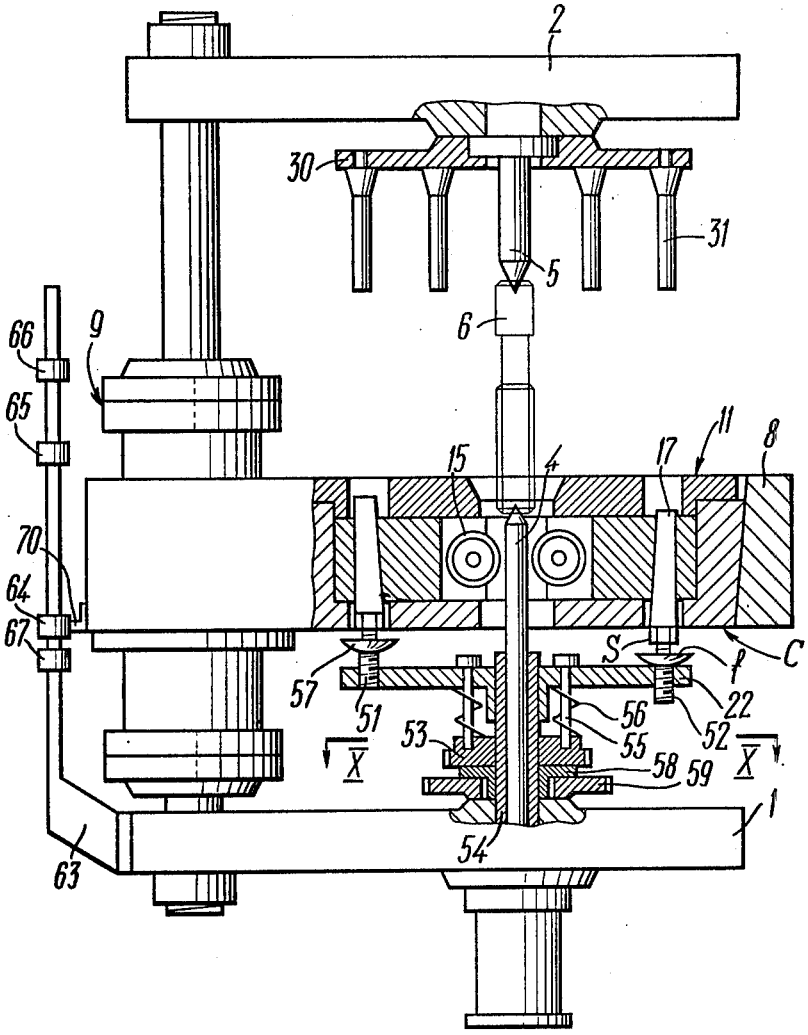
FIG. 7 is the same view of FIG. 4 for another embodiment of the present invention.
Figure 8:
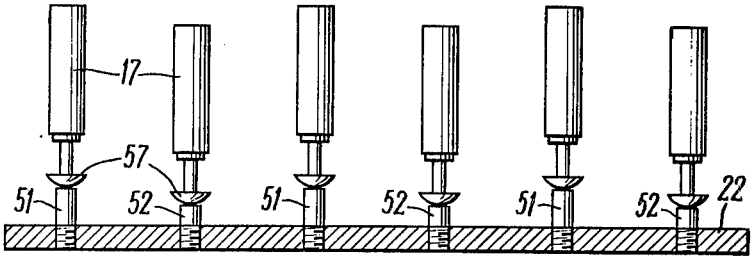
FIG. 8 is a turn view of the arrangement of different height stops according to the invention, in an enlarged scale.

According to still another embodiment of the present invention, as an intermediate part use is made of a master former located on the disc 22 and having a profile to provide for a preset radial feed of the knurl rollers 15. According to the invention, the master former is made in the way of different height stops 51 (FIG. 7) and 52 located on the disc 22 equidistantly on the circumference whereas each stop is in front of the respective base of the tapered elements 17. The stops 51 and 52 made in the form of bars are adjustable in height. Each of said bars by one end is screwed into the threaded hole made in the disc 22 on its periphery. The stops 51 have equal height which differs from that of the stops 52. The stops 51 and 52 are installed so that the stop 51 follows the stop 52 (as shown in FIG. 8). The total number of different height stops 51 and 52 is equal to that of tapered elements 17.

Figure 9:
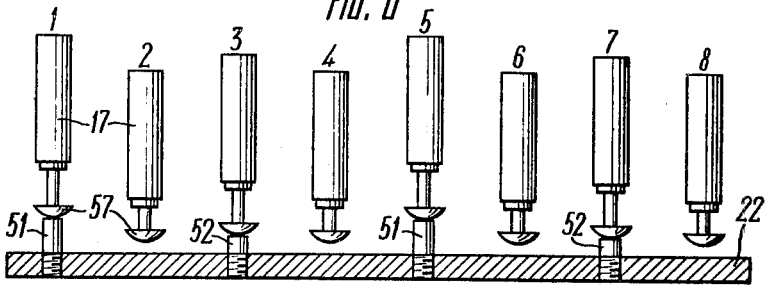
FIG. 9 is the same view of FIG. 8 for another embodiment of the invention.

In another embodiment of the present invention the different height stops 51 and 52 are situated in front of the bases of each second tapered element 17 (as shown in FIG. 9), i.e. two tapered elements 17 for one stop. The total amount of different height stops 51 and 52 is twice less than that of tapered elements 17.

The first embodiment of the present invention when the total amount of different height stops 51 and 52 is equal to the number of tapered elements 17 is used for knurling the profiles of splines on the shafts when the amount of splines is comparatively small such as six splines.

The second embodiment of the present invention when the total amount of the different height stops 51 and 52 is equal to the number of tapered elements 17 is used for knurling the profiles with a comparatively great number of homogeneous elements such as teeth of gears (more than six teeth).

When the master former is used as an intermediate part, the disc 22 is rotary about its vertical axis which coincides with the axis of the centers 4 and 5. For the purpose use is made of a known ratchet-and-pawl mechanism located between the disc 22 and the fixed support member 1 coaxially to the movable center 4.

This ratchet-and-pawl mechanism has a ratchet wheel 53 (FIG. 7) being coaxial to the movable center 4. Mounted in the fixed traverse 1 is a cylindrical way 54 wherethrough the movable center 4 passes (as shown in FIG. 7). The ratchet wheel 53 is fixed on this cylindrical way 54 and associated with the disc 22 by bolts 55. The bolts 55 freely pass through the holes in the disc 22 and are screwed by their ends into the butt end of the ratchet wheel 53. Put on each of these bolts 55 is a compression spring 56 whose one end is loaded to the butt end of the ratchet wheel 53 and the other end is loaded to the butt of the disc 22. Screwed into the base of each tapered element 17 is a bolt 57 having a hemispheric head.

Figure 10:
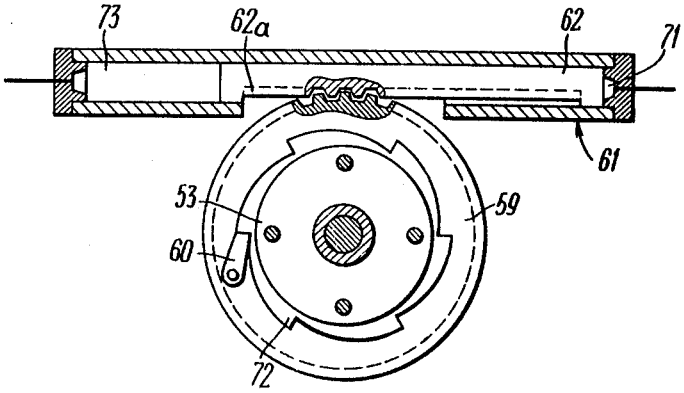
FIG. 10 is a section of X—X of FIG. 7 in an enlarged scale.

Installed coaxially to the ratchet wheel 53 on the cylindrical way 54 is an intermediate sleeve 58. Installed on this sleeve 58 (as shown in FIG. 7) is a drive gear 59 coupled to the ratchet wheel 53 through a pawl 60 (FIG. 10). The axle of rotation of the pawl 60 is secured in the butt end of the drive gear 59.

Mounted on the fixed support member 1 near the drive gear 59 is a jack 61 with a plunger 62. The plunger 62 is provided with a rack 62*a* being in a constant mesh with the drive gear 59.

In this embodiment of the device for moving the knurl rollers 15 radially relative to the centers 4 and 5 the amount of pressure members 31 (FIG. 7) for returning the knurl rollers 15 to the starting position is equal to the number of tapered elements 17 and each of said pressure members is located in front of a respective tapered element 17.

Secured onto the fixed support member 1 is a stand 63 (FIGS. 1,4,6 and 7). Mounted on this stand 63 are end switches 64–69 in such a way that their position may be adjusted. Mounted on the movable support members 8 at the side of the stand 63 is a catch 70 for actuating in turn the end switches 64–69 in the course of movement of the movable support members 8.

The profile plano-type knurling machine operates in the automatic mode as follows:

Prior to knurling the knurling machine is adjusted, for example, for knurling the splines of a shaft, by performing the following operations. A control measuring cylindrical mandrel whose diameter is equal to that of the circumference of roots of the splines, is placed in the centers 4 and 5. The movable support members 8 with the knurling head 11 is moved upwards until the knurl rollers 15 are set at the middle portion of the mandrel height. The tapered elements 17 are moved to displace the sliders 14 with the knurl rollers 15 in the radial slots 13 until the knurl rollers 15 contact the mandrel. In the event the flat ring 27 by its butt end touch the butt end C of the knurling head 11.

Thereafter the movable support member 8 is moved towards the fixed traverse 1 until the disc 22 for the radial feed of the knurl rollers 15 begins actuating the flat ring 27. When the movable support member 8 is in this position the end switch 68 on the stand 63 is adjusted at the level of the catch 70. The other end switches 65–67 are set due to the radial feed value prior to each subsequent working travel of the movable support member 8 with the knurling head 11 and due to the length of the work piece to be knurled. Thereafter the movable support member is returned to the starting position which corresponds to the position of the knurling head 11 prior to its first working travel. The end switch 64 is set at the level of the catch 70. Hence the tapered elements 17 are moved in such a way that the sliders 14 with the knurl rollers 15 should be placed apart from the mandrel at a distance equal to the summary radial feed of the knurl rollers 15 for the full shaping of the profile to be knurled.

When the adjustment of the knurling machine is finished, the mandrel is removed and the work piece (FIG. 1) is placed in the centers 4 and 5 by clamping it with the aid of the movable center 4. The movable traverse 8 is in the starting position wherein the catch 70 actuates the end switch 64. The ring 27 supports the disc 22 and the position of the tapered elements 17 corresponds to the starting position of the knurl rollers 15. A fluid is supplied from the pressure source (not shown) into the cavities of the jacks 9. The movable support member 8 with the knurling head 11 begins moving along the ways 3 upwards. The knurl rollers 15 begin working the workpiece 6. Performed are the first working travel of the knurling head 11 and the knurling of the profile elements. The movable support member 8 moves upwards until the catch 70 begins actuating the end switch 65. The end switch 65 advances a signal for feeding the fluid into cavities M of the jacks 9. The movable support member 8 with the knurling head 11 moves downwards. In the course of the backward travel of the movable support member 8 with the knurling head 11 the knurl rollers 15 contact the work piece 6 and work it within the range of elastic deformations. This travel of the movable support member 8 with the knurling head 11 is idle since the profile is not shaped.

At the end of this travel the ring 27 approaches the disc 22 and actuates it. The disc 22 supports the ring 27 and moves it together with the tapered elements 17 secured thereon. In the course of this movement the tapered elements 17 actuate the sliders 14 carrying the knurl rollers 15 and move them in the slots 13. Thus, the knurl rollers 15 are fed radially relative to the centers 4 and 5 for the next working travel of the knurling head 11. The catch 70 actuates the end switch 66 which advances a signal for a backward travel of the movable support member 8 with the knurling head 11. In receiving this signal the movable support member 8 with the knurling head 11 again moves upwards to the end switch 65.

In the course of this travel the knurl rollers 15 again process the work piece 6 and continue shaping the profile elements. Thus, the movable support member 8 with the knurling head 11 performs reciprocations wherein the catch 70 successively actuates the end switches 65-67-68. When performing the last radial feed of the knurl rollers 15 in the knurling cycle the ring 27 moves to contact the butt end C of the knurling head 11, thus providing the stable extreme position of the tapered elements 17 and therefore the knurl rollers 15 at the last working travel of the knurling head 11. The compression springs 26 (FIG. 3) are used as dampers. The compression force of these springs 26 is calculated in such a way that it should be more than that required for moving the tapered elements 17, thus ensuring the accuracy of the radial feed of the knurl rollers 15.

When the movable support member 8 with the knurling head 11 goes forward the catch 70 begins actuating the end switch 64 which advances a signal for stopping the movable support member 8. The knurling cycle is finished. The knurled piece is released from the centers 4 and 5 and removed from the processing area.

After the work piece has been removed the fluid from the pressure source is supplied to the cavities N of the jacks 9. The movable support member 8 with the knurling head 11 moves upwards to the end switch 69. When it approaches the end switch 69 the stops 31 actuate the apeces of the respective tapered elements 17 and move them downwards to the starting position. In the course of this movement of tapered elements 17 the a compression springs 19 (FIG. 2) return the sliders 14 with the knurl rollers 15 to the starting position. The catch 70 actuates the end switch 69 which advances a signal for reversing the movable support member 8 and returning it to the starting position. The next work piece 6 is placed and the adjustment cycle is repeated.

When as pressure members for returning the knurl rollers 15 to the starting position use is made of movable members 33 of the jacks 32 said return of the knurl rollers 15 is performed as follows:

When the profile knurling cycle is finished the fluid from the pressure source is supplied simultaneously into the rod cavity 37 of the jack 7 (FIG. 4) and cavities of the jacks 32 communicated therewith through a flexible pipe line 38.

Under the effect of fluid the piston *7a* of the jack 7 together with the movable center 4 is moved downwards (in the plane of drawing in FIG. 4). The knurled piece 6 is released from the centers 4 and 5 and removed. At the same time the plunger 33 moves downwards driving the ring 27 associated therewith and accommodating therein the bases of the tapered elements 17. Thus, the tapered elements 17 are moved and therefore the knurl rollers are moved to the starting position. As a result the movement of the movable support member 8 with the knurling head 11 to the fixed support member 2 for returning the knurl rollers 15 to the starting position is eliminated. For a reliable fixing of the plungers 33 and therefore the tapered elements 17 associated therewith by means of the ring 27 use is made of braking devices 33*a*. In these devices the slide blocks 40 (FIG. 5) under the effect of the springs 42 are pressed to the flat 41 of the plunger 33 and retained by forces of friction in a required position, thus preventing the tapered elements 17 from any optional movements.

When the device for moving the knurl rollers 15 radially relative to the centers 4 and 5 is provided with a double-arm levers 44 the tapered elements 17 are moved as follows:

After the movement of the movable support member 8 with the knurling head 11 from the starting position to the end switch 65 has been finished, i.e. its first working travel is over, the stops 49 (FIG. 6) begin actuating the free ends of the respective double-arm levers 44, rotating them about their axes 45. As a result the ring 27 coupled to other ends of the double-arm levers 44 moves upwards (in the plane of drawing in FIG. 6), thus driving the tapered elements 17 associated therewith. Thus, the next radial feed of the knurl rollers 15 for a preset value is performed. When the catch 70 actuates the end switch 65 which advances a signal for performing a backward travel of the movable support member 8.

In the course of this backward travel of the movable support member 8 with the knurling head 11 the knurl rollers 15 again begin processing the work piece 6, shaping the profile elements and therefore this travel will be also a working travel. When this travel has been finished, the ring 27 begins actuating the disc 22 and moves upwards performing the next radial feed of the knurl rollers 15. The further working travel is performed to the end switch 67 and the backward travel is carried out to the end switch 64. Thereafter in actuating the catch 70 the end switch 64 to generate a signal the movable support member 8 with the knurling head 11 is stopped. After the movable support member 8 has been stopped the knurled piece is removed from the processing area.

After the knurled piece has been removed the fluid from the pressure source is supplied into the cavities M of the jacks 9. The movable support member 8 with the knurling head 11 moves to the end switch 68.

In this movement the free ends of the double-arm levers 44 begin actuating the stops 31. As a result the ring 27 together with the tapered elements 17 moves downwards (in the plane of drawing in FIG. 6) returning the knurl rollers 15 to the starting position. The movable support member 8 with the knurling head 11 moves until the catch 70 begins actuating the end switch 64 which advances a signal to stop the movable traverse 8 in the starting position.

Figure 11:
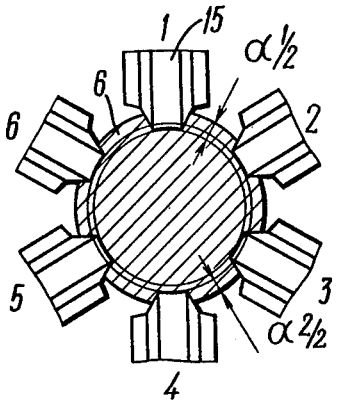
FIG. 11 shows a position of knurl rollers in the course of the first working travel of the movable support member with the knurling head, according to the invention, when as an intermediate part use is made of a master former in the form of different height stops, in an enlarged scale.

When the intermediate part is made in the form of different height stops the profile plano-type knurling machine operates as follows: The knurling machine is adjusted prior to knurling by performing operations described above. After the tapered 17 and sliders 14 with the knurl rollers 15 are set to the starting position, the bolts 57 are screwed into the bases of the tapered 17 until butt ends f of their heads touch the butt end C of the knurling head 11. Thereafter the movable support member 8 with the knurling head 11 is displaced to the starting position whereas the catch 70 begins actuating the end switch 64. The end switch 64 advances a signal for stopping this support member 8. Thereafter the cotters 17 move downwards (in the plane of drawing in FIG. 7) in such a way that a gap S equal to a preset value of the radial feed of the knurl rollers 15 should be established between the butt end f of the head of each bolt 57 and the butt end C of the knurling head 11. The gap S for each second tapered element 17 corresponds to the radial feed $\alpha_1/2$ (FIG. 11) of the knurl rollers 15 having ordinal numbers 1,3 and 5 mean while for the other tapered elements, to the radial feed $\alpha_2/2$. The stops 51 and 52 are screwed until they touch the spherical surface of heads of the bolts 57 of the respective tapered elements. The stops 51 are installed so that their height is more than that of the stops 52. The adjustment process is finished. The control measuring mandrel is released from the centers 4 and 5 and the work piece 6 is placed therebetween and clamped with the aid of the movable center 4.

The fluid from the pressure source is supplied to the cavities N of the jacks 9. The movable support member 8 with the knurling head 11 moves upwards (in the plane of drawing in FIG. 7). In the course of this movement the knurl rollers 15 process the work piece 6, shaping the profile according to the radial feed of the knurl rollers 15 having ordinal numbers 1,3 and 5 (FIG. 11) to a value equal to $\alpha_1/2$ and the other to a value equal to $\alpha_2/2$.

The movable support member 8 (FIG. 7) with the knurling head 11 moves upwards until the catch 70 begins actuating the end switch 65 which advances a signal for reversing the movable support member 8.

The fluid from the pressure source is supplied simultaneously to the cacity 71 (FIG. 10) of the jack 61 of the ratchet-and-pawl mechanism. The plunger 62 with the rack 62*a* moves to the left (in the plane of drawing in FIG. 10). The rack 62*a* actuates the drive gear 59, thus driving it counter clockwise (in the plane of drawing in FIG. 10). The pawl 60 also rotates counterclockwise until it engages the next adjacent tooth 72 of the ratchet wheel 53.

After the signal for reversing is received, the movable support member 8 (FIG. 7) with the knurling head 11 begins moving downwards. Simultaneously with the signal for reversing the movable support member 8 the end switch 65 advances a signal for feeding the fluid into the cavity 73 (FIG. 10) of the jack 61 and for discharging the fluid from the cavity 71.

The plunger 62 with the rack 62*a* moves to the right (in the plane of drawing in FIG. 10) rotating the drive gear 59 with the pawl 60 clockwise (in the plane of drawing in FIG. 10). The pawl 60 being in mesh with the tooth 72 of the ratchet wheel 53 rotates this wheel 53 together with the disc 22 (FIG. 7) to an angle corresponding to an angular pitch in the arrangement of the cotters 17. When the disc 22 rotates the stops 51 and 52 change their positions, i.e. under the tapered elements whereunder the stops 51 have been now the stops 52 are located.

Figure 12:
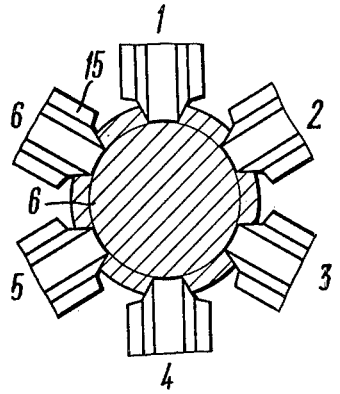
FIG. 12 is the same view of FIG. 11 for the second working travel of the movable traverse with the knurling head.

At the end of the travel of the movable support member 8 the stops 51 begin actuating the respective tapered elements 17 driving them to a value corresponding to the difference of heights of the stops 51 and 52. As a result the knurl rollers 15 having ordinal numbers 2, 4 and 6 are fed to a value equal to $\alpha_1/2 - \alpha_2/2$ (FIG. 12). As a result all the tapered elements 17 acquire an equal position in height and the knurl rollers 15 acquire the equal position relative to the axis of the work piece 6 (as shown in FIG. 12).

After the tapered elements 17 have been adjusted in height the end switch 64 advances a signal for reversing the movable support members 8 with the knurling head 11.

The movable support members 8 with the knurling head 11 performs the next working travel wherein the knurl rollers 15 having ordinal numbers 2, 4 and 6 shape the profile and the knurl rollers 15 having ordinal numbers 1, 3 and 5 calibrate the elements of the profile being knurled.

Figure 13:
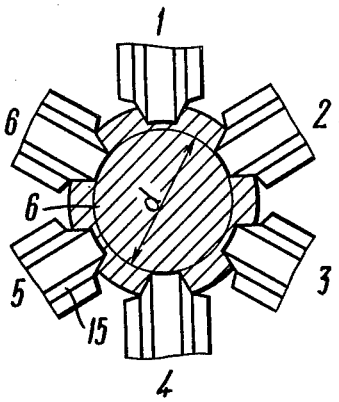
FIG. 13 is the same view of FIG. 11 for the next working travel of the movable traverse with the knurling head.
Figure 14:
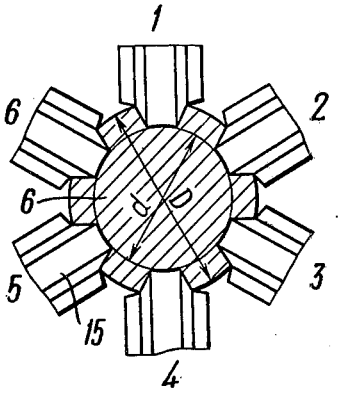
FIG. 14 is the same of FIG. 11 for the last working travel of the movable traverse with the knurling head.

At the subsequent radial feeds the knurl rollers 15 acquire positions shown in FIGS. 13 and 14. As a result the summary feed of each knurl roller 15 is equal to a halved difference of diameter D of the work piece 6 and diameter *d* of the roots of the knurled profile.

In the course of knurling the profile the catch 70 successively actuates the end switches 64 to 67.

After the knurling process has been finished the catch 70 actuates the end switch 64 which advances a signal for stopping the movable support member 8 with the knurling head 11. The knurled piece is released from the centers 4 and 5.

The movable support member 8 is fed with a signal for moving it towards the fixed support member 2. At the end of this movement the stops 31 begin actuating the tapered elements 17, driving them to the starting position. The catch 70 begins actuating the end switch 66 which advances a signal for returning the movable support member 8 to the starting position.

Figure 15:
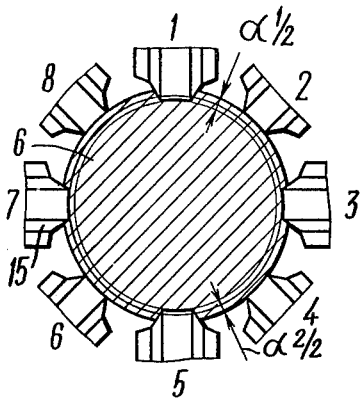
FIG. 15 is the same view of FIG. 11 for another embodiment of the invention.
Figure 16:
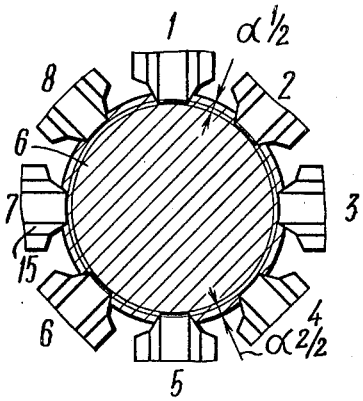
FIG. 16 is the same view of FIG. 15 for the second working travel of the knurling head with the knurl rollers.
Figure 17:
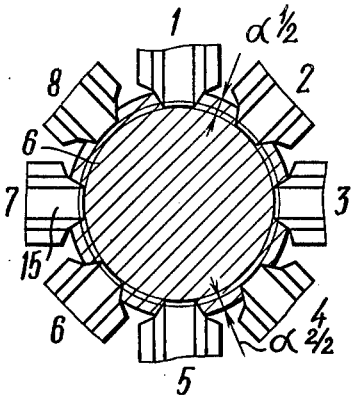
FIG. 17 is the same view of FIG. 15 for the third working travel of the knurling head with the knurl rollers.

Assume that the knurling machine operates for knurling a shaft with eight splines. The different height stops 51 and 52 are located in front of the base of each second tapered element 17 (FIG. 9) i.e. over one tapered elements 17. The amount of stops 51 and 52 is 2 times less than that of the tapered elements 17. The knurling machine is adjusted in away similar to that used to adjust the machine having the amount of the different height stops 51 and 52 equal to the number of tapered elements 17. The stops 51 are located in front of the bases of tapered elements 17 having ordinal numbers 1 and 15 and the stops 52 are located in front of the tapered elements 17 having ordinal numbers 3 and 7. When the knurling machine operates the movement of the tapered elements 17 and therefore the radial feed of the knurl rollers 15 are performed as follows: As shown in FIG. 9 for the first working travel of the knurling head 11 with the knurl rollers 15 the tapered elements 17 having ordinal numbers 1 and 5 are moved to a value corresponding to the radial feed of the respective knurl rollers 15 (FIG. 15) and equal to $\alpha_1/2$ and the tapered elements 17 having ordinal numbers 3 and 7 are moved to a value equal to $\alpha_2/2$. Prior to the next working travel of the knurling head 11 with the knurl rollers 15 the disc 22 rotates in the described manner to an angle equal to the angular pitchoof the arrangement of tapered elements 17. The stops 51 are located in front of the tapered elements 17 having ordinal numbers 2 and 6 and the stops 52 are located in front of the tapered elements 17 having ordinal numbers 4 and 8. As a result the knurl rollers 15 (FIG. 16) having ordinal numbers 2 and 6 are fed radially relative to the centers 4 and 5 to a value $\alpha_1/2$ and the knurl rollers 15 having ordinal numbers 4 and 8 are fed to a value $\alpha_2/2$. In the course of this working travel of the knurling head 11 the profile is shaped by the knurl rollers 15 having ordinal numbers 2, 4, 6 and 8 while the other knurl rollers 15 process the work piece 6 within a range of elestic deformations only. Prior to the next working travel of the knurling head 11 the disc 22 rotates in the same direction to an angle of the same value as in the preceding working travel of the knurling head 11. Now the stops 51 acquire the position in front of the tapered elements 17 having ordinal numbers 3 and 7 while the stops 52 acquire the position in front of the cotters 17 having ordinal numbers 5 and 1. As a result the knurl rollers 15 having ordinal numbers 3 and 7 are moved towards the work piece 6 to a value equal to $\alpha_1/2 - \alpha_2/2$. In the course of the second working travel of the knurling head 11 the profile is shaped by the knurl rollers 15 (FIG. 17) having ordinal numbers 3 and 7 while the other knurl rollers 15 process the work piece 6 within the range of elastic deformations only. At the next working travel of the knurling head 11 the stops 51 acquire the position in front of the tapered elements 17 having ordinal numbers 4 and 8 and the stops 52 acquire the position in front of the tapered elements 17 having ordinal numbers 5 and 1.

Figure 18:
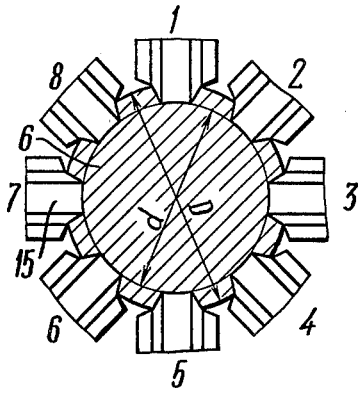
FIG. 18 is the same view of FIG. 15 for the next working travel of the knurling head with the knurl rollers, according to the invention.

The knurl rollers 15 having ordinal numbers 4 and 8 (FIG. 18) are moved towards the work piece 6 by a value equal to $\alpha_1/2 - \alpha_2/2$ and shape the profile to be knurled. The other knurl rollers 15 process the work piece 6 within a range of elastic deformations only.

The further shaping of the profile to be knurled is carried out in the sequence of radial feeds of the knurl rollers 15 as described above.

Thus, due to the application of the device for moving the knurl rollers 15 radially relative to the centers 4 and 5 wherein as an intermediate part use is made of a master former in the form of different height stops 51 and 52 the feed of the knurl rollers 15 to the work piece 6 is performed simultaneously to a different value as shown in FIGS. 11 to 18. This pattern diagram of the radial feed of the knurl rollers 15 permits to perform the method for knurling the profiles which permits to eliminate the bending of the work piece being knurled and to raise the accuracy of the profile to be knurled.

The distinctive feature of this method consists of the fact that due to a non-uniform squeezing of the portions in the transversal section of the work piece 6 (FIG. 13) under the effect of the knurl rollers 15 the plastic deformation cells are localized in the peripheral zones of the transversal section of the work piece 6 only, thus making the metal flow in the radial direction.

As a result a core of the work piece 6 in the portion wherein the knurl rollers 15 shapes the metal along the work piece 6 is in the elastic state, keeping its original strength.

This feature permits to eliminate any bending of the work piece 6 in the course of knurling, thus raising the accuracy of the profile elements being knurled.

What we claim is:

1. An improved profile planotype knurling machine of the type having fixed support members; movable and fixed centers for placing a work piece, mounted on said fixed support members; ways rigidly coupling said fixed support members; a movable support member mounted between said fixed support members on said ways with a possibility for reciprocations along said ways; a knurling head with knurl rollers, mounted in said movable support member coaxially to said centers; the improvement comprising: means for moving said knurl rollers radially relative to said centers; a plurality of tapered elements mounted in said knurling head for providing adjustment motions axially relative to said centers said tapered members being associated kinematically with said knurl rollers; a unitary disc-shaped pressure member for providing the radial feed of said knurl rollers, and being mounted on one of said fixed support members facing the butt end of said tapered elements coaxially to said centers and adapted for contacting said actuating means during one motion of said reciprocations whereby said unitary disc-shaped pressure member and said actuating means cooperate to actuate simultaneously all said tapered elements; a plurality of return pressure members being mounted on one of said fixed support members opposite said unitary disc-shaped pressure member for returning said tapered elements to the starting position and said actuating means being located between said unitary disc-shaped pressure member and the bases of the tapered elements.

2. A machine as claimed in claim 1, wherein the unitary disc-shaped pressure member is resiliently pressed towards the movable support member.

3. A machine as claimed in claim 1, wherein the actuating means is made in the form of a flat ring coupling to each other the tapered elements and having the diameter of the hole less than that of the unitary disc-shaped pressure member whereas the number of said plurality of return pressure members for returning the knurl rollers to the starting position is less than the number of tapered elements.

4. A machine as claimed in claim 3 wherein the number of said return pressure members for returning the knurl rollers to the starting position is two when there are an even number of tapered elements and is three when there is an odd number of tapered elements and said return pressure members are situated equidistantly from each other.

5. A machine as claimed in claim 3, wherein said return pressure members for returning the knurl rollers to the starting position comprise jacks wherein movable members of the jacks are associated with said flat ring whereas fixed members of the jacks are mounted in the movable support member.

6. A machine as claimed in claim 5, wherein the movable members of the jacks are provided with braking devices mounted in the movable support member.

7. A machine as claimed in claim 3, wherein said means for moving the knurl rollers radially relative to the centers comprises double-arm levers whose axes of rotation are mounted on the movable support member, each of them hinged by one end to said flat ring, and additional pressure members for the radial feed of the knurl rollers, located on the fixed support member at the side of apeces of the tapered elements so that each of them is located in front of the free end of the respective double-arm lever whereas the pressure members for returning the knurl rollers to the starting position are mounted on the fixed support member at the side of the bases of said tapered element in such a way that each of them should be located in front of one of said additional pressure members.

8. A machine as claimed in claim 7, wherein the number of double-arm levers is in the range of two to three and the number of additional pressure members for the radial feed of knurl rollers is equal to the number of double-arm levers.

9. A machine as claimed in claim 7, wherein the additional pressure members for the radial feed of knurl rollers are made in the form of bars, each of them being rigidly secured onto the fixed support member and its axis being parallel to the centers.

10. A machine as claimed in claim 1, further comprising a master former located on said disc-shaped pressure member and having the profile to provide for the preset radial feed of the knurl rollers.

11. A machine as claimed in claim 10, wherein the master former is made in the form of different height stops located on said disc-shaped pressure member uniformly along the circumference, each of them being in front of a respective tapered element whereas said disc-shaped pressure member is pivoted with a possibility for rotation about its axis.

12. A machine as claimed in claim 11, wherein different height stops are installed in height in such a way that the adjacent stops have different heights whereas each other stop has an equal height.

13. A machine as claimed in claim 12, wherein the stops are made so that their height is adjustable.

14. A machine as claimed in claim 11, further comprising means for rotating said disc-shaped pressure member including a ratchet-and-pawl mechanism associated with said disc-shaped pressure member through the ratchet wheel and with a drive gear through the pawl.

* * * * *